US012270268B1

(12) United States Patent
Al-Malki et al.

(10) Patent No.: US 12,270,268 B1
(45) Date of Patent: Apr. 8, 2025

(54) LOST CIRCULATION MATERIAL TOOL

(71) Applicant: Saudi Arabian Oil Company, Dhahran (SA)

(72) Inventors: Bandar S. Al-Malki, Dammam (SA); Abdullah Essa Alnoaimi, Dhahran (SA); Hassan K. Al-Aswad, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/597,009

(22) Filed: Mar. 6, 2024

(51) Int. Cl.

| | |
|---|---|
| ***E21B 21/10*** | (2006.01) |
| ***E21B 21/00*** | (2006.01) |
| ***E21B 21/08*** | (2006.01) |
| ***E21B 34/14*** | (2006.01) |

(52) U.S. Cl.
CPC ..... *E21B 21/103* (2013.01); *E21B 21/003* (2013.01); *E21B 21/08* (2013.01); *E21B 34/14* (2013.01)

(58) Field of Classification Search
CPC ..... E21B 21/08; E21B 21/003; E21B 21/103; E21B 34/14
See application file for complete search history.

(56) References Cited

U.S. PATENT DOCUMENTS

| | | | | |
|---|---|---|---|---|
| 8,844,653 | B2 | 9/2014 | deBoer | |
| 9,145,748 | B1 * | 9/2015 | Meier | E21B 21/103 |
| 10,590,737 | B2 | 3/2020 | Churchill | |
| 2016/0024884 | A1 * | 1/2016 | Baudoin | E21B 21/103 166/334.4 |

FOREIGN PATENT DOCUMENTS

| | | |
|---|---|---|
| AU | 2017292912 | 4/2023 |
| EP | 2188486 | 10/2011 |

* cited by examiner

*Primary Examiner* — Dany E Akakpo
(74) *Attorney, Agent, or Firm* — Fish & Richardson P.C.

(57) ABSTRACT

A downhole tool includes a tool body including an uphole joint and a downhole joint configured to couple within a wellbore tubing string that extends in a wellbore. One or more flow directing paths are formed on an outer surface of the tool body and configured to rotate a portion of the tool body in response to a fluid flow within the wellbore tubing string. One or more ports are disposed around a circumference of the tool body; and a piston is configured to adjust between an open position such that the one or more ports are open to enable injection of a lost circulation material circulated through the tool body and into the wellbore and a closed position such that the one or more ports are closed to block injection of the lost circulation material into the wellbore from the tool body.

22 Claims, 5 Drawing Sheets

LOST CIRCULATION MATERIAL TOOL

TECHNICAL FIELD

This disclosure relates to a wellbore tool for mitigating lost circulation material in the wellbore.

BACKGROUND

In drilling and workover operations, drilling fluid can flow into the subterranean formation through the walls of a wellbore causing a loss of circulation of the wellbore. Loss of circulation can be caused by, for example, poor subterranean formation integrity, high pore pressure in the subterranean formation, high fracture in the subterranean formation, improper drilling fluid design, inadequate mud weight, and/or poor wellbore cleaning.

SUMMARY

In an example implementation, a downhole tool includes a tool body including an uphole joint and a downhole joint configured to couple within a wellbore tubing string that extends in a wellbore from a terranean surface to at least one subterranean formation. The downhole tool includes one or more flow directing paths formed on an outer surface of the tool body, and the one or more flow directing paths are configured to rotate a portion of the tool body in response to a fluid flow within the wellbore tubing string. One or more ports are disposed around a circumference of the tool body; and a piston is configured to adjust between an open position such that the one or more ports are open to enable injection of a lost circulation material circulated through the tool body and into the wellbore and a closed position such that the one or more ports are closed to block injection of the lost circulation material into the wellbore from the tool body.

An aspect combinable with the example implementation includes a motor operably coupled to the piston to move the piston between the open position and the closed position.

Another aspect combinable with one, some, or all of the previous aspects includes a rack gear coupled to the piston; and a pinion gear coupled to the motor and mated with the rack gear, where the motor is operable to rotate the pinion gear to cause translation of the rack gear to move the piston.

Another aspect combinable with one, some, or all of the previous aspects includes a differential pressure gauge coupled to a downhole portion of the tool body and configured to measure a fluid pressure of fluids in the wellbore.

Another aspect combinable with one, some, or all of the previous aspects includes acoustic sensors coupled to the tool body near the one or more ports, and the acoustic sensors are configured to detect acoustic data indicating a loss of circulation.

Another aspect combinable with one, some, or all of the previous aspects includes one or more flow velocity sensors coupled to the tool body configured to measure a flow velocity of the fluids in the wellbore.

Another aspect combinable with one, some, or all of the previous aspects includes a controller operable to move the piston in response to an indication of lost circulation.

In another aspect combinable with one, some, or all of the previous aspects, a rotation rate of the portion of the tool body indicates lost circulation when the rotation rate exceeds a threshold rotation rate.

In another example implementation, a system includes a downhole tool including a tool body including an uphole joint and a downhole joint configured to couple within a wellbore tubing string that extends in a wellbore from a terranean surface to at least one subterranean formation. One or more flow directing paths are formed on an outer surface of the tool body and configured to rotate a portion of the tool body in response to a fluid flow within the wellbore tubing string; one or more ports disposed around a circumference of the tool body, The downhole tool includes a piston configured to adjust between an open position such that the one or more ports are open to enable injection of a lost circulation material circulated through the tool body and into the wellbore and a closed position such that the one or more ports are closed to block injection of the lost circulation material into the wellbore from the tool body. The system includes a controller operable to cause the piston to move between the closed position and the open position in response to an indication of lost circulation material.

An aspect combinable with the example implementation includes a motor operably coupled to the piston to move the piston between the open position and the closed position, where the controller is operable to control the motor.

Another aspect combinable with one, some, or all of the previous aspects includes a rack gear coupled to the piston; and a pinion gear coupled to the motor and mated with the rack gear, where the motor is operable to rotate the pinion gear to cause translation of the rack gear to move the piston.

In another aspect combinable with one, some, or all of the previous aspects, the indication of lost circulation material is based on a rotation rate of the portion of the tool body.

Another aspect combinable with one, some, or all of the previous aspects includes a differential pressure gauge coupled to a downhole portion of the tool body and configured to measure a fluid pressure of fluids in the wellbore wherein the indication of lost circulation materials is further based on the fluid pressure.

Another aspect combinable with one, some, or all of the previous aspects includes acoustic sensors coupled to the tool body near the one or more ports, and the acoustic sensor are configured to measure acoustic data, where the indication of lost circulation materials is further based on the acoustic data.

Another aspect combinable with one, some, or all of the previous aspects includes flow velocity sensors coupled to the tool body configured to measure a flow velocity of the fluids in the wellbore where the indication of lost circulation materials is further based on the flow velocity.

In another example implementation, a method includes measuring a rotation rate of a portion of a downhole tool including one or more flow directing paths formed on an outer surface of the downhole tool; determining that a loss of circulation in a wellbore has occurred based on the rotation rate; in response to determining that the loss of circulation has occurred, opening one or more ports of the downhole tool to inject lost circulation material into the wellbore.

An aspect combinable with the example implementation includes measuring a differential pressure of drilling fluid in the wellbore, where determining that the loss of circulation has occurred is based on the rotation rate and the differential pressure.

Another aspect combinable with one, some, or all of the previous aspects includes measuring acoustic data using acoustic sensors coupled to the downhole tool near the one or more ports, wherein determining that the loss of circulation has occurred is based on the rotation rate and the acoustic data.

Another aspect combinable with one, some, or all of the previous aspects includes measuring a flow velocity of drilling fluids flowing through the downhole tool, where determining that the loss of circulation has occurred is based on the rotation rate and the flow velocity.

In another aspect combinable with one, some, or all of the previous aspects, opening the one or more ports of the downhole tool includes moving a piston of the downhole tool to open the ports.

In another aspect combinable with one, some, or all of the previous aspects, moving the piston includes operating a motor coupled to a pinion gear, wherein the pinion gear is mated with a rack gear attached to the piston.

Another aspect combinable with one, some, or all of the previous aspects includes determining that circulation has been restored based on the rotation rate; and in response to determining that the circulation has been restored, closing the one or more ports of the downhole tool.

Implementations of a downhole tool for mitigating lost circulation material in a wellbore according to the present disclosure may include one or more of the following technical advantages. For example, implementations according to the present disclosure can provide early detection of lost circulation using one or more sensors in the downhole tool thereby enabling prompt intervention. Prompt intervention of lost circulation can reduce the amount wellbore fluid that escapes into the subterranean formation reducing formation damage and improving wellbore stability. The systems and methods of this disclosure can reduce risks of well control events (e.g., uncontrolled flows of fluids lasting longer than 60 minutes) and reduce the cost of drilling and workover operations. Lost circulation materials can be injected into the well near the location of the affected lost circulation zone.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of a downhole tool that can couple to a portion of a wellbore tubing string, such as drill pipe, coiled tubing, during a drilling operation of a wellbore. Example implementations of the downhole tool, when installed on the wellbore tubing string, can mitigate loss of circulation in the wellbore by injecting lost circulation material into the wellbore when a loss of circulation is detected. The downhole tool can automatically open ports to inject the lost circulation material in response to detecting one or more fluid parameters (e.g., pressure, flow rate) from the wellbore that indicate that circulation has been lost. By promptly injecting the lost circulation material, example implementations of the downhole tool can reduce a likelihood of wellbore instability, formation damage, well control events, and/or increased drilling costs.

Figure 1A:
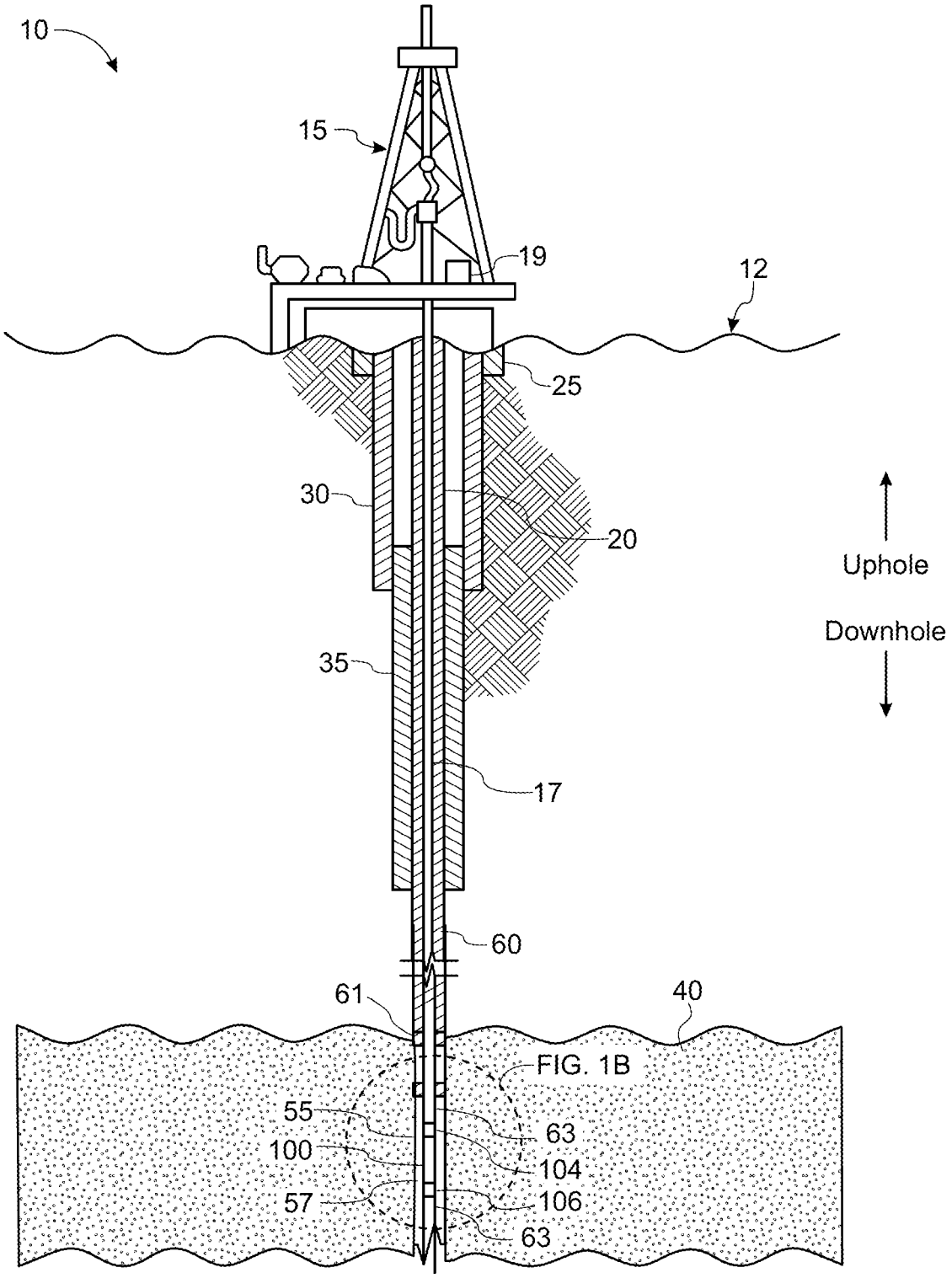
FIGS. 1A and 1B are schematic diagrams of an example wellbore system that includes at least one lost circulation material tool according to the present disclosure.
Figure 1B:
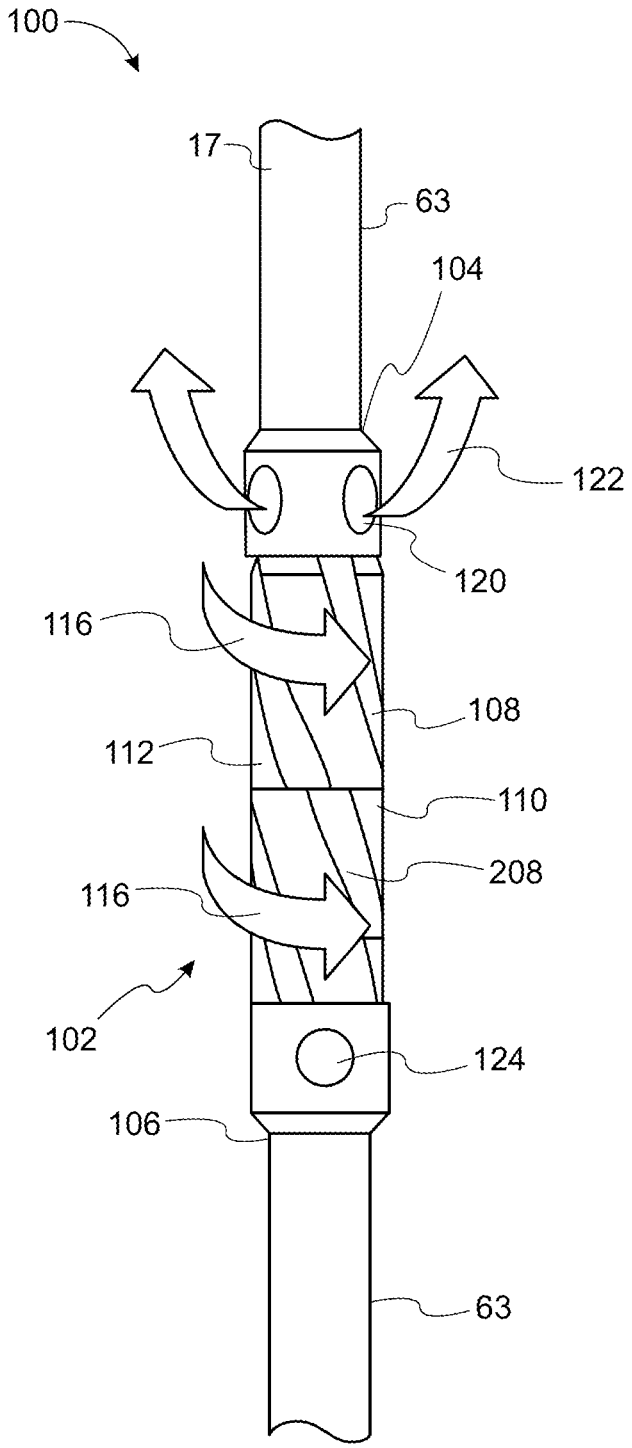

FIGS. 1A and 1B are schematic diagrams of an example wellbore system 10 that includes at least one downhole tool 100 for mitigating lost circulation in a wellbore according to the present disclosure. As shown more specifically in FIG. 1B (which shows a closer view of a portion of the wellbore system 10), the one or more downhole tools 100 (e.g., lost circulation tools) can be installed on portions of a wellbore tubing string 17 that, among other components, is made up of pipe segments 63 that are coupled (for example, threadingly) together to form the string 17.

As shown, the wellbore system 10 accesses a subterranean formation 40, and provides access to hydrocarbons located in such subterranean formation 40, also called reservoir 40. In an example implementation of system 10, the system 10 may be used for a drilling operation as well as a production operation to produce hydrocarbons through the wellbore tubular string. However, in some aspects, system 10 does not include a drilling rig but does include a wellhead with one or more surface valves as well as a valve control system to control the surface valves, one or more downhole smart valves, or both.

As illustrated in FIG. 1A, an implementation of the wellbore system 10 includes a rig assembly (or "assembly") 15 deployed on a terranean surface 12. The assembly 15 can generally represent a drilling assembly that can be used to form the wellbore 20 extending from the terranean surface 12 and through one or more geological formations in the Earth, as well as a production assembly to produce hydrocarbons, water, or both from the one or more geological formations. One or more subterranean formations, such as subterranean formation 40, are located under the terranean surface 12. One or more wellbore casings, such as a surface casing 30 and intermediate casing 35, may be installed in at least a portion of the wellbore 20 (for example subsequent to completion of the drilling operation or some other time).

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the assembly 15 may be any appropriate assembly or drilling rig used to form wellbores or boreholes in the Earth. The assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string and a drill bit (or bottom hole assembly that includes a drill bit). In some embodiments, the assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As a production assembly, the assembly 15 can include certain aforementioned components, as well as the wellbore tubular string 17, or production string 17, through which a production fluid (for example, hydrocarbons, water, or a combination thereof) can be produced from subterranean formation 40 to the terranean surface 12. One or more production seals 61 (such as production tubing packers) can be installed on the production string 17 as shown in order to hold particular components of the string 17 in place in the wellbore 20.

The downhole tool 100 includes a tool body 102. The tool body 102 includes an uphole joint 104 and a downhole joint 106 to couple the downhole tool 100 to the wellbore tubing string 17. For example, the uphole joint 104 and/or the downhole joint 106 are threaded joints that can be threadingly coupled to the drill pipe segments 63.

A portion 112 of the tool body 102 includes one or more flow directing paths 108 on an outer surface 110 of the tool body 102. The flow directing paths 108 can be, for example, helical or spiral paths. The portion 112 is configured to rotate 116 in response to a flow of fluid inside the tool body 102 and/or in the annulus of the wellbore between the tool body 102 and the sides 55 of the wellbore 20. The rotation rate of the portion 112 of the tool body 102 can indicate a loss of circulation of wellbore fluids within the wellbore. For example, a fluid flowing within the tool body 102 can cause the portion 112 to rotate in a first direction. Fluid flowing in the annulus can exert a force on the portion 112 to cause the portion 112 to reduce the rotation rate in the first direction. If loss of circulation occurs, no fluid (or substantially no fluid) will be flowing in the annulus 57 and the portion 112 will rotate at a higher rotation rate due to the absence of the resistance of fluid flowing in the annulus 57.

The downhole tool 100 includes one or more ports 120 that can be opened to inject 122 lost circulation material (LCM) into the wellbore 20. For example, the LCM can be pumped by the assembly 15 at the surface through the wellbore tubing string 17 and through the one or more ports 120 of the downhole tool 100 after the one or more ports 120 are opened. The LCM materials can seal or plug the fracture in the formation, mitigating fluid losses and promoting wellbore integrity. The one or more ports 120 are located at an uphole end of the tool body 102 (e.g., near the uphole joint 104). The one or more ports 120 can include automated mechanism for opening and closing the one or more ports 120 in response to measurements from one or more sensors 124. The one or more sensors 124 can include, for example, differential pressure sensors, acoustic sensors, temperature sensors, and/or flow velocity sensors.

Differential pressure sensors measure a pressure difference between two or more locations in along a flow path. For example, the differential pressure sensor can measure a pressure at a first location near the uphole joint 104 of the downhole tool 100 and at a second location near the downhole joint 106. The difference in the pressure between the first location and the second location would be the differential pressure. Alternatively, or additionally, a differential pressure sensor can measure a pressure within the tool body 102 and a pressure on the outside of the tool body 102. A sudden change (e.g., increase or decrease) in pressure differential as measured by the differential pressure sensor can indicate that fluid a loss of circulation is occurring (e.g., fluid is escaping into the formation).

Acoustic sensors can be used to measure sound waves generated by wellbore fluids (e.g., drilling fluid). The acoustic sensors include, for example, hydrophones that are compatible with the wellbore fluid and the expected intensity and frequency of the sound waves generated in the wellbore. A sudden change (e.g., increase or decrease) in sound wave intensity and/or frequency can indicate that fluid is escaping into the formation.

Flow velocity sensors measure the flow velocity of the wellbore fluid. The flow velocity can be internal to the tool body 102 or external to the downhole tool 100. A sudden increase or decrease in flow velocity can indicate that fluid is escaping into the formation. The rotation rate of the portion 112 of the tool body 102 can indicate flow velocity. Other methods of measuring the flow velocity can also be used, for example, hall effect flow sensors, turbine flow meters, ultrasonic flow meters, pitot tubes, orifice plates, etc.

The one or more sensors 124 are in electronic communication with a controller 19 (e.g., a computer or data processing system). The controller 19 can receive signals from the sensors and determine when a loss of circulation occurs. The controller 19 can generate commands to operate the downhole tool 100 to inject LCM into the wellbore in response to determining that loss of circulation has occurred. The controller 19 can be electronically coupled to the downhole tool 100 through, for example, wires or fiber optic cables. In implementations using fiber optic cables, the one or more sensors 124 and the controller 19 can transmit optical signals using lasers and/or light emitting diodes (LEDs). In some implementations, the controller, is located within the downhole tool 100.

Figure 2:
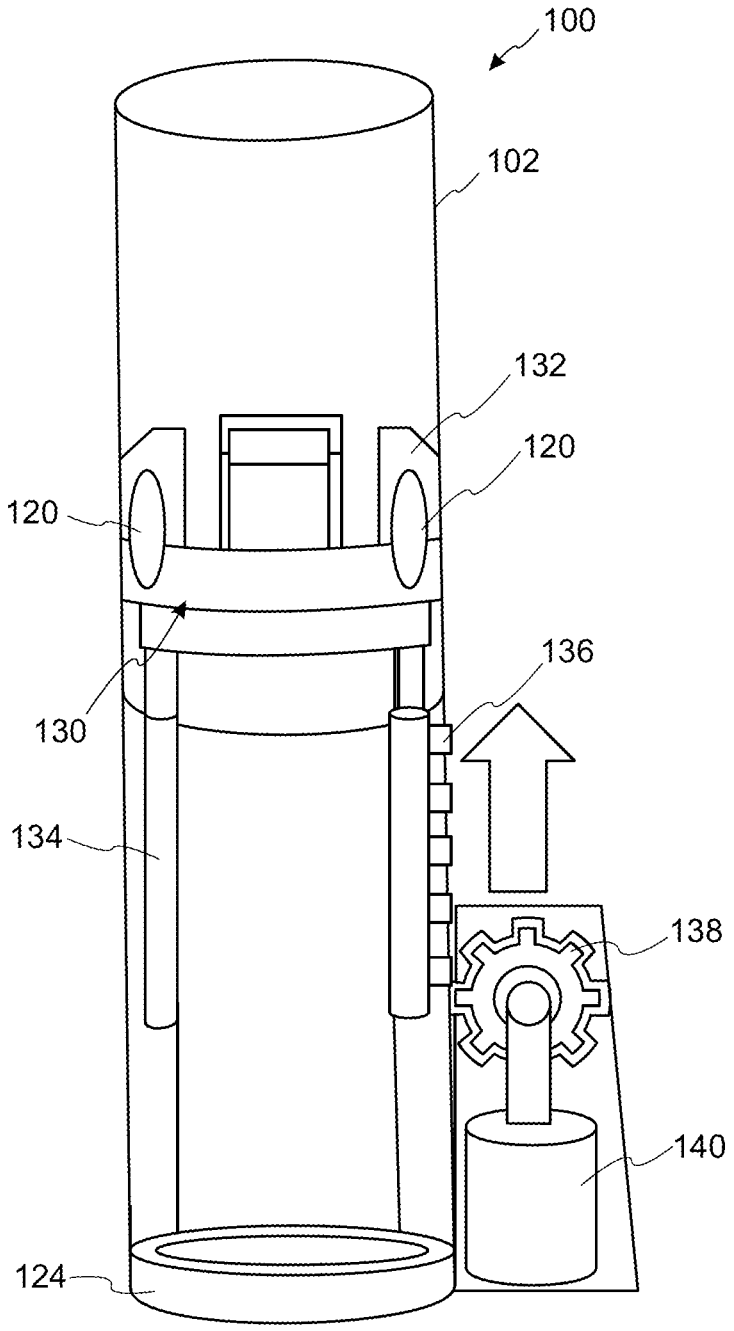
FIG. 2 is a schematic diagram of an example implementation of a lost circulation material tool according to the present disclosure.
Figure 3:
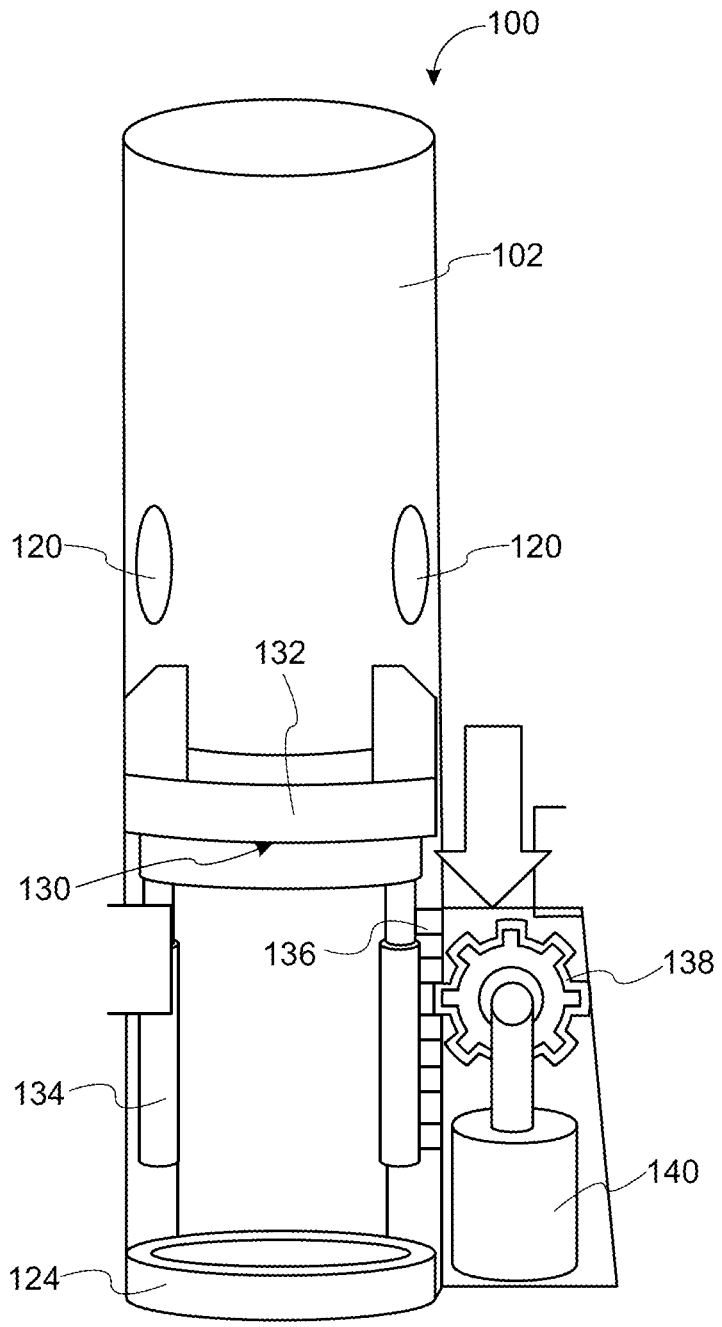
FIG. 3 is a schematic diagram of an example implementation of a lost circulation material tool according to the present disclosure.

FIG. 2 shows a schematic of the downhole tool 100 with the one or more ports 120 in a closed position. FIG. 3 shows a schematic of the downhole tool 100 with the one or more ports 120 in an open position. The downhole tool 100 includes a piston assembly 130 within the tool body 102. The piston assembly 130 includes a piston 132 that blocks the one or more ports 120 when the one or more ports 120 are in a closed position. The piston 132 prevent LCM from being injected into the wellbore when the one or more ports are in the closed position.

The piston assembly 130 can be translated within the tool body 102 between the open position and the closed position. The piston assembly 130 includes rails 134 that position the piston assembly 130 within the tool body. The rails 134 also guide the piston assembly 130 during a translating movement. One of the rails 134 includes a rack gear 136 that is mated with a pinion gear 138. Rotation of the pinion gear 138 causes translation of the rack gear 136. Translation of the rack gear 136 causes translation of the piston assembly 130. The pinion gear 138 is coupled to a motor 140. The motor 140 causes the pinion gear 138 to rotate in response to receiving a command from the controller 19 to open or close the one or more ports 120.

In some implementations, the piston assembly 130 can be translated through other means. For example, the piston assembly 130 can be coupled to a linear actuator that can extend or retract to cause the translating movement of the piston assembly 130. The linear actuator can be electrically powered or hydraulically powered. In another example, one of the rails 134 of the piston assembly 130 can be coupled to a worm gear such that rotation of the worm gear causes translation of the piston assembly 130.

In the open position (shown in FIG. 3), the piston assembly 130 has translated in a downhole direction 142. The controller 19 can cause the piston assembly 130 to open the one or more ports 120 in response to receiving a signal from the one or more sensors 124 indicating that a loss of circulation has occurred. For example, the controller 19 can send a command to the motor 140 to rotate and turn the pinion gear 138, which in turn translates the rack gear 136 and the piston assembly. LCM held within the downhole tool 100 is injected into the wellbore when the one or more ports 120 are in the open position.

In response to determining that circulation has been reestablished in the wellbore, the controller 19 can generate commands to cause the motor 140 to close the one or more ports 120 by translating the piston assembly 130 to the closed position where the one or more ports are blocked and flow of the LCM from the tool body 102 into the wellbore is impeded.

In some implementations, the piston 130 moves in an uphole direction to open the one or more ports 120 and moves in downhole direction to close the one or more ports 120. For example, the piston assembly 130 can be positioned uphole of the one or more ports 120.

A process for operating a downhole tool (e.g., downhole tool 100) to mitigate lost circulation in a wellbore of a subsurface formation can be implemented on or with a controller (e.g., controller 19). The process can be performed in real-time where real-time performance includes operating on data as the data become available to devices requesting the data immediately (e.g., within milliseconds, tens of milliseconds, or hundreds of milliseconds) in a first-in, first-out manner. In some implementations, non-real-time performance is also possible in which data are stored for processing at a later time.

In an example process, the process can include measuring, by the controller, a rotation rate of a portion of the downhole tool that includes one or more flow directing paths formed on an outer surface of the downhole tool. For example, the controller receives a signal from one or more sensors indicating a rotation rate of the portion of the downhole tool. The controller determines that a loss of circulation in the wellbore has occurred based on the rotation rate. For example, the controller determines that the rotation rate has increased above a threshold rotation rate. In response to determining that the loss of circulation has occurred, the controller opens one or more ports of the downhole tool to inject lost circulation material into the wellbore. For example, the controller causes a piston of the downhole tool to move to open the one or more ports.

In some implementations, the process includes measuring a differential pressure of drilling fluid in the wellbore. The controller can determine that a loss of circulation has occurred based on the rotation rate and the differential pressure. For example, the controller can determine that the rotation rate exceeds a threshold rotation rate, and that a change in the differential pressure measurement exceeds a threshold pressure change.

In some implementations, the process includes measuring acoustic data using acoustic sensors coupled to the downhole tool near the one or more ports. The controller can determine that the loss of circulation has occurred based on the rotation rate, the differential pressure, and/or the acoustic data.

In some implementations, the controller opens the one or more ports by operating a motor coupled to a pinion gear. The pinion gear is mated with a rack gear attached to the piston, and rotation of the pinion gear causes translation of the rack gear and the piston. Operating the motor can include generating and sending control commands from the controller to the motor.

In some implementations, the controller determines that circulation has been restored based on one or more of the rotation rate, the differential pressure, and the acoustic data. In response to determining that the circulation has been restored, the controller closes the one or more ports of the downhole tool. For example, the controller generates commands to operate the motor to move the piston to close the one or more ports.

Figure 4:
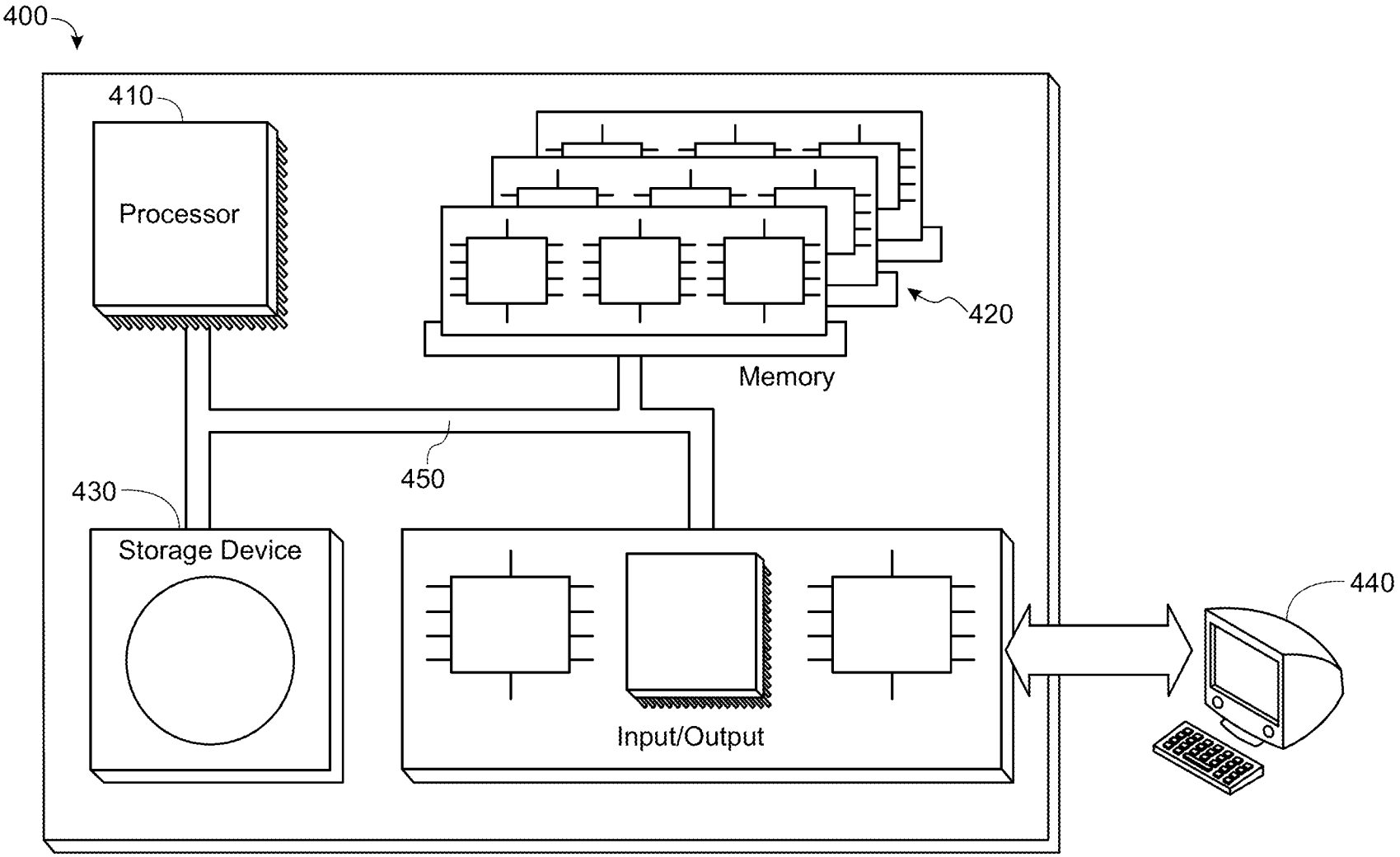
FIG. 4 shows a schematic drawing of a control system.

FIG. 4 shows a schematic drawing of a control system 400 that can be used in the example wellbore tool of FIGS. 1A-3 according to the present disclosure. For example, all or parts of the control system (or controller) 400 can be used for the operations described previously, for example as or as part of the controller 19. The controller 400 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives can store operating systems and other applications. The USB flash drives can include input/output components, such as a wireless transmitter or USB connector that can be inserted into a USB port of another computing device.

The controller 400 includes a processor 410, a memory 420, a storage device 430, and an input/output device 440. Each of the components 410, 420, 430, and 440 are interconnected using a system bus 450. The processor 410 is capable of processing instructions for execution within the controller 400. The processor can be designed using any of a number of architectures. For example, the processor 410 can be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the control system 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the controller 400. In one implementation, the storage device 430 is a computer-readable medium. In various different implementations, the storage device 430 can be a floppy disk device, a hard disk device, an optical disk device, a tape device, flash memory, a solid state device (SSD), or a combination thereof.

The input/output device 440 provides input/output operations for the controller 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what can be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications can be made without departing from the spirit and scope of the disclosure. For example, example operations, methods, or processes described herein can include more steps or fewer steps than those described. Further, the steps in such example operations, methods, or processes can be performed in different successions than that described or illustrated in the figures. Accordingly, other implementations are within the scope of the following claims.

What is claimed is:

1. A downhole tool comprising:

a tool body comprising an uphole joint and a downhole joint configured to couple within a wellbore tubing string that extends in a wellbore from a terranean surface to at least one subterranean formation;

one or more flow directing paths formed on an outer surface of the tool body and configured to rotate a portion of the tool body in response to a fluid flow within the wellbore tubing string;

one or more ports disposed around a circumference of the tool body; and a piston configured to adjust between an open position such that the one or more ports are open to enable injection of a lost circulation material circulated through the tool body and into the wellbore and a closed position such that the one or more ports are closed to block injection of the lost circulation material into the wellbore from the tool body.

2. The downhole tool of claim 1, further comprising: a motor operably coupled to the piston to move the piston between the open position and the closed position.

3. The downhole tool of claim 2, further comprising: a rack gear coupled to the piston; and a pinion gear coupled to the motor and mated with the rack gear, wherein the motor is operable to rotate the pinion gear to cause translation of the rack gear to move the piston.

4. The downhole tool of claim 1, further comprising a differential pressure gauge coupled to a downhole portion of the tool body and configured to measure a fluid pressure of fluids in the wellbore.

5. The downhole tool of claim 4, further comprising: acoustic sensors coupled to the tool body near the one or more ports, the acoustic sensor configured to detect acoustic data indicating a loss of circulation.

6. The downhole tool of claim 5, further comprising one or more flow velocity sensors coupled to the tool body configured to measure a flow velocity of the fluids in the wellbore.

7. The downhole tool of claim 1, further comprising a controller operable to move the piston in response to an indication of lost circulation.

8. The downhole tool of claim 7, wherein a rotation rate of the portion of the tool body indicates lost circulation when the rotation rate exceeds a threshold rotation rate.

9. A system comprising:

a downhole tool comprising:

a tool body comprising an uphole joint and a downhole joint configured to couple within a wellbore tubing string that extends in a wellbore from a terranean surface to at least one subterranean formation;

one or more flow directing paths formed on an outer surface of the tool body and configured to rotate a portion of the tool body in response to a fluid flow within the wellbore tubing string;

one or more ports disposed around a circumference of the tool body; and a piston configured to adjust between an open position such that the one or more ports are open to enable injection of a lost circulation material circulated through the tool body and into the wellbore and a closed position such that the one or more ports are closed to block injection of the lost circulation material into the wellbore from the tool body; and a controller operable to cause the piston to move between the closed position and the open position in response to an indication of lost circulation material.

10. The system of claim 9, further comprising a motor operably coupled to the piston to move the piston between the open position and the closed position, wherein the controller is operable to control the motor.

11. The system of claim 10, further comprising:

a rack gear coupled to the piston; and a pinion gear coupled to the motor and mated with the rack gear, wherein the motor is operable to rotate the pinion gear to cause translation of the rack gear to move the piston.

12. The system of claim 9, wherein the indication of lost circulation material is based on a rotation rate of the portion of the tool body.

13. The system of claim 12, further comprising a differential pressure gauge coupled to a downhole portion of the tool body and configured to measure a fluid pressure of fluids in the wellbore wherein the indication of lost circulation materials is further based on the fluid pressure.

14. The system of claim 13, further comprising: acoustic sensors coupled to the tool body near the one or more ports, the acoustic sensor configured to measure acoustic data, wherein the indication of lost circulation materials is further based on the acoustic data.

15. The system of claim 14, further comprising: flow velocity sensors coupled to the tool body configured to measure a flow velocity of the fluids in the wellbore wherein the indication of lost circulation materials is further based on the flow velocity.

16. A method comprising:

measuring a rotation rate of a portion of a downhole tool comprising one or more flow directing paths formed on an outer surface of the downhole tool;

determining that a loss of circulation in a wellbore has occurred based on the rotation rate;

in response to determining that the loss of circulation has occurred, opening one or more ports of the downhole tool to inject lost circulation material into the wellbore.

17. The method of claim 16, further comprising measuring a differential pressure of drilling fluid in the wellbore, wherein determining that the loss of circulation has occurred is based on the rotation rate and the differential pressure.

18. The method of claim 16, further comprising: measuring acoustic data using acoustic sensors coupled to the downhole tool near the one or more ports, wherein determining that the loss of circulation has occurred is based on the rotation rate and the acoustic data.

19. The method of claim 16, further comprising: measuring a flow velocity of drilling fluids flowing through the downhole tool, wherein determining that the loss of circulation has occurred is based on the rotation rate and the flow velocity.

20. The method of claim 16, wherein opening the one or more ports of the downhole tool comprises moving a piston of the downhole tool to open the ports.

21. The method of claim 20, wherein moving the piston comprises operating a motor coupled to a pinion gear, wherein the pinion gear is mated with a rack gear attached to the piston.

22. The method of claim 16, further comprising:

determining that circulation has been restored based on the rotation rate; and in response to determining that the circulation has been restored, closing the one or more ports of the downhole tool.

* * * * *